US005446952A

United States Patent [19]

Kim et al.

[11] Patent Number: 5,446,952

[45] Date of Patent: Sep. 5, 1995

[54] PNEUMATIC INDUCTION FIBER SPREADER WITH LATERAL VENTURI RESTRICTORS

[75] Inventors: Chulko Kim, Burke, Va.; Robert A. Gray, Jr., Huntingtown, Md.

[73] Assignee: The United States of America as represented by the Secretary of the Navy, Washington, D.C.

[21] Appl. No.: 131,684

[22] Filed: Dec. 11, 1987

[51] Int. Cl.[6] ..... D01D 11/02

[52] U.S. Cl. ..... 28/283; 28/271; 19/299; 261/DIG. 56

[58] Field of Search ..... 28/283, 273, 103, 271; 226/7; 19/299; 261/DIG. 56

[56] References Cited

U.S. PATENT DOCUMENTS

| | | | |
|---|---|---|---|
| 2,664,010 | 12/1953 | Emerson | 28/273 X |
| 3,795,944 | 3/1974 | Daniels | 28/283 |
| 3,873,389 | 3/1975 | Danials . | |
| 3,894,563 | 7/1975 | Pausch | 261/DIG. 56 X |

*Primary Examiner*—Peter A. Nelson

*Attorney, Agent, or Firm*—Edward F. Miles; Thomas E. McDonnell

[57] ABSTRACT

A machine for producing a graphite fiber tape suitable for use in the production of metal matrix composites by physical vapor deposition. The machine consists of adjacent air-tight enclosures. Two venturi pipes are located within the enclosures and aligned with a gap between them. A vacuum pump draws air out of one of the air-tight enclosures. Graphite fibers are drawn through the venturi pipes and laterally spread from a tow bundle via the Venturi effect to form a thin tape.

11 Claims, 2 Drawing Sheets

PNEUMATIC INDUCTION FIBER SPREADER WITH LATERAL VENTURI RESTRICTORS

FIELD OF THE INVENTION

This invention relates to the production of structural materials, and more particularly to a machine for spreading graphite fibers prior to their use in the production of graphite fiber reinforced light metals.

BACKGROUND OF THE INVENTION

Metal matrix composites are formed when graphite fibers are embodied in light metals such as aluminum, magnesium, and titanium. These composites are used in structures which are subject to severe environments since they have low mass density, low thermal explansion, high strength, and high thermal and electricdal conductivities.

Metal matrix composites are conventionally produced by infiltrating tows of graphite fibers with molten metal to produce precursor wires which are subsequently collimated and consolidated to form the composite. However, this technique produces material with low transverse tensile strength and cannot produce sheets less than one-half millimeter thick.

To overcome these deficiencies, a method for the physical vapor deposition of metal matrix onto graphite fibers has been developed. This produces ultra-thin composite precursor tapes. Multiple layers of these tapes are consolidated by a hot diffusion bonding process to form composite sheets as thin as 0.1 millimeter. A uniform coating of metal onto individual filaments of these procursor tapes is required for their successful consolidation. When the fibers are not well spread, the interior fibers receive an insufficient coating of metal during the physical vapor deposition process. The absence of coating on the interior fibers, and the resulting non-uniform metal matrix distribution in the consolidated end product, produce a metal matrix composite with inferior strength properties.

A previous attempt at pneumatic spreading of filaments used compressed air jets through pipes to fluff or lay open bundles of fibrous strands while they were collimated and spread. U.S. Pat. No. 3,873,389, Pneumatic Spreading of Filaments, Clare G. Daniels, Mar. 25, 1975. Restrictors were used to adjust the width of the openings of the pipes. However, the restrictors were installed normal to the pipe width such that the fibers were forced to spread as a result of the restriction of pipe dimension rather than as a direct result of the Venturi effect. Tows were spread to a compact tape form of several layers thick without any control over the spacing between adjacent collimated fibers.

We previously attempted to develop a fiber spreading technique using a mechanical method wherein the fiber tow was pulled through a series of laterally oscillating rollers. The term "fiber" used collectively, and the term "fibers," are used interchangeably herein to denote a collection of strands which, collectively, constitute fiber tows. The alternate motion of the rollers spread the fiber tow by frictional force into a compact tape of two or three fibers thick with no control over the spacings between the fibers. Furthermore, fiber breakage due to the frictional nature of mechanical spreading presented process complications.

SUMMARY OF THE INVENTION

The object of this invention is to transform a graphite fiber tow into a thin tape suitable for use in the production of metal matrix composites by physical vapor deposition.

This and other objects of the invention are achieved by drawing graphite fibers from a spool through a series of air-tight enclosures. A vacuum pump is used to force air flow through venturi pipes and into one of the air-tight enclosures, thus spreading the graphite fibers by means of the Venturi effect. The fiber is then interleaved with aluminum foil and collected on a second spool.

BRIEF DESCRIPTION OF THE DRAWINGS

This invention will be best understood by referring to the accompanying drawings, wherein.

DETAILED DESCRIPTION OF THE PREFERRED EMBODIMENT

Figure 1:
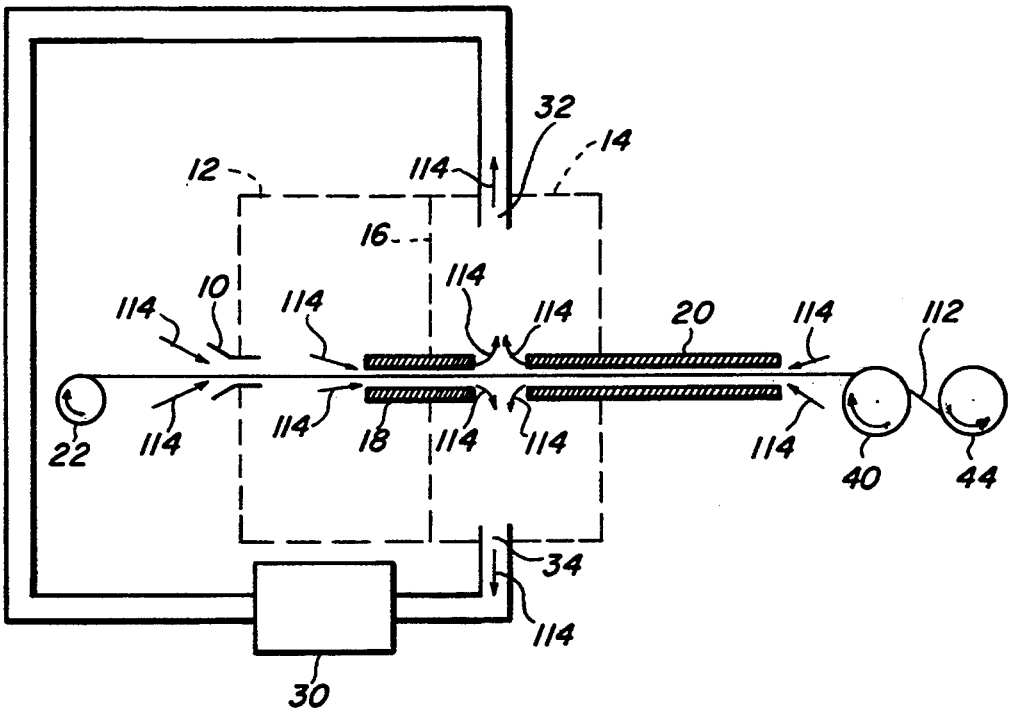
FIG. 1 illustrates a side view of the fiber spreading machine, with arrows indicating the direction of air flow.
Figure 2:
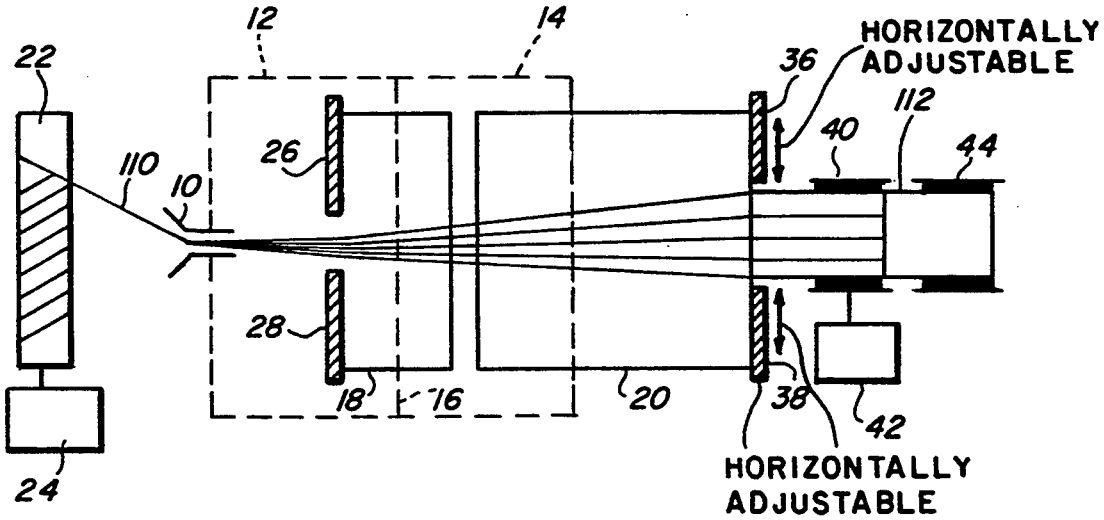
FIG. 2 illustrates a top view of the fiber spreading machine.

The Venturi effect is a local drop in air pressure at the site of a pipe constriction. FIGS. 1 and FIG. 2 illustrate a machine that uses the Venturi effect to spread graphite fiber bundle 110 from a tow bundle and interleave the spread graphite fibers with aluminum foil 112. An inlet funnel 10 extends from a first air-tight enclosure 12. A second air-tight enclosure 14 is located adjacent to the first air-tight enclosure 12, such that there is a common partition 16 between the first air-tight enclosure 12 and the second air-tight enclosure 14. A first venturi pipe 18 pierces the common partition 16 such that one end of the first venturi pipe 18 is located within the first air-tight enclosure 12 and the opposite end of the first venturi pipe 18 is located within the second air-tight enclosure 14. A second venturi pipe 20 pierces the side of the second air-tight enclosure 14 which is opposite to the common partition 16 such that one end of the second venturi pipe 20 is located within the second air-tight enclosure 14 and the opposite end of the second venturi pipe 20 extends outside of the second air-tight enclosure 14. The second venturi pipe 20 is aligned with the first venturi pipe 18. There is a gap between the first venturi pipe 18 and the second venturi pipe 20.

By way of example, the inside dimensions of the first venturi pipe 18 may be 13 cm long, 33 cm wide and 0.635 cm high. The inside dimensions of the second venturi pipe 20 may be 60 cm long, 33 cm wide, and 0.635 cm high. The gap is less than 2.5 cm.

A first spool 22 holds the graphite fiber 110 initially. A first variable-speed motor 24 is attached to the first spool 22. A first horizontally adjustable restrictor 26 and second horizontally adjustable restrictor 28 are located at opposite sides of the end of the first venturi pipe 18 which is within the first air-tight enclosure 12. These first and second horizontally adjustable restrictors 26, 28 can be adjusted to control the width of the opening of the first venturi pipe 18. This causes the air stream to expand as it moves through the first venturi pipe towards the gap between the first venturi pipe 18 and the second venturi pipe 20, thus producing the Venturi effect inside the first venturi pipe 18.

A vacuum pump 30 connected to the second air-tight enclosure 14 through a top outlet 32 and a bottom outlet 34 in the second air-tight enclosure 14 is used to draw air out of the second air-tight enclosure 14. Laminar air flows inside the second venturi pipe 20 when the second air-tight enclosure 14 is evacuated with the vacuum pump 30. A third horizontally adjustable restrictor 36 and a fourth horizontally adjustable restrictor 38 are located at opposite sides of the end of the second venturi pipe 20 which extends outside of the second air-tight enclosure 14. These third and fourth horizontally adjustable restrictors 36, 38 can be adjusted to control the width of the opening of the second venturi pipe 20. A pressure gradient is created across the second venturi pipe 20 by constricting the third horizontally adjustable restrictor 36 and the fourth horizontally adjustable restrictor 38. Due to this pressure differential, the air entering the second venturi pipe 20 flows toward the sides of the second venturi pipe 20. This diverging air stream forces the fibers to spread laterally along the width of the second venturi pipe 20.

A second spool 40 attached to a second variable-speed motor 42 is used for collecting the graphite fiber after it has been spread. A third spool 44 wound with aluminum foil is located adjacent the second spool 40.

In operation, the first variable-speed motor 24 and the second variable-speed motor 42 draw the graphite fiber 110 from the first spool 22, through the inlet funnel 10, and through the first and second venturi pipes 18, 20. As the air expands in the first venturi pipe 18, the graphite fibers 110 are dispersed laterally into a pre-spread mode. The graphite fiber 110 is then drawn through the second venturi pipe 20, where the diverging air stream forces the fibers to spread laterally along the width of the second venturi pipe 20. The major fiber spreading action takes place within the second venturi pipe 20. The spread graphite fiber 110 is then collected around the second spool 40 due to the rotation of the second spool by the second variable-speed motor 42.

Bowing of the outer fibers in the spread graphite fiber bundle 110 can be controlled by the tension applied to the graphite fibers. This adjustment is accomplished by regulating the first variable-speed motor 24 and the second variable-speed motor 42 which are coupled to the first spool 22 and second spool 40 respectively.

The third spool 44 turns in the direction opposite that of the second spool 40 and feeds into the second spool 40 such that the aluminum foil 112 is pulled by the second spool as the second spool turns and a layer of aluminum foil 112 is interleaved with the spread graphite fiber 110 as the spread graphite fiber 110 is wound around the second spool 40.

Figure 3:
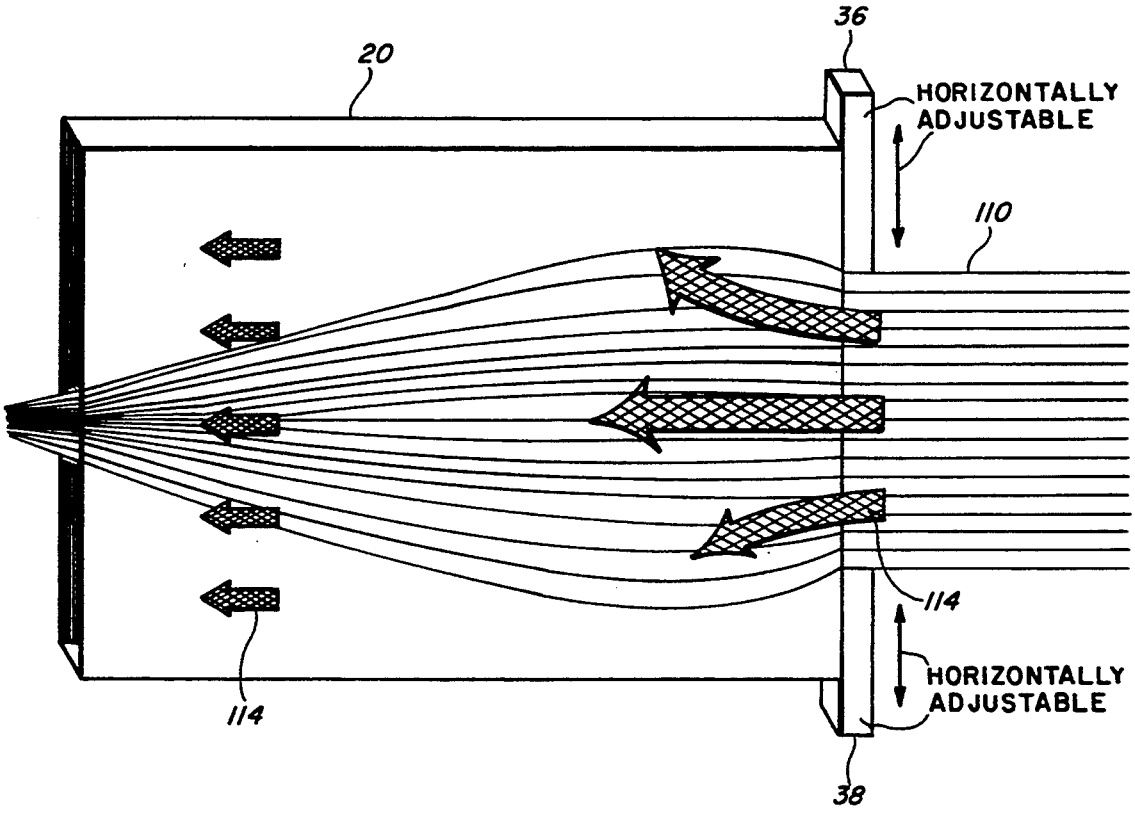
FIG. 3 illustrates the spreading of graphite fibers due to the Venturi effect.

FIG. 3 illustrates the spreading of graphite fibers in the second venturi pipe 20 due to the Venturi effect. The arrows represent the direction of air movement through the second venturi pipe 20. The arrows 114 in FIGS. 1, 2 and 3 indicate general direction of air flow.

What is claimed is:

1. A machine for spreading graphite fiber from a tow bundle, collecting the fibers on a spool, and interleaving the graphite fibers with aluminum foil comprising:

a) a first air-tight enclosure, b) an inlet funnel which pierces said first air-tight enclosure, c) a second air-tight enclosure located adjacent to said first air-tight enclosure, said second air-tight enclosure having an outlet, d) a vacuum pump connected to said outlet for drawing air out of said second air-tight enclosure, e) a common partition between said first air-tight enclosure and said second air-tight enclosure, f) a first venturi pipe which pierces said common partition such that one end of said first venturi pipe is located within said first air-tight enclosure and the opposite end of said first venturi pipe is located within said second air-tight enclosure, g) first and second horizontally adjustable said second spool, and o) a third spool spaced from said second spool and wound with aluminum foil for delivering the foil to the second spool such that the spread graphite fibers are wound around said second spool with a layer of aluminum foil interleaved with the spread graphite fibers.

2. A machine for spreading and collimating a tow of fiber, said machine comprising:

an enclosure;

circulating means for circulating air through said enclosure;

pulling means for pulling said tow of fiber through said enclosure;

uniform cross-section venturi means for subjecting said tow in said enclosure to a laminar flow of air downstream of said venturi means responsive to said circulating means.

3. The machine of claim 2, wherein said venturi means comprises a venturi orifice, said orifice comprises a movable restriction means for covering a preselected portion of said orifice, said covering of said preselected portion of said orifice being effective to cause said laminar flow of air.

4. The machine of claim 3, wherein said movable restriction is horizontally movable, said covering of said preselected portion by horizontal movement of said movable restriction being effective to cause said laminar flow of air to be in a substantially horizontal plane, whereby to cause said fibers to spread in said substantially horizontal plane.

5. The machine of claim 4, wherein said movable restriction is one or more plates adapted to slide horizontally across said venturi orifice transverse to said circulating air.

6. The machine of claim 5, wherein said venturi orifice is an opening on the surface of said enclosure.

7. The machine of claim 2, wherein said machine comprises a preblower stage, said preblower stage comprising:

a compartment, said compartment comprising a preblower venturi;

wherein said pulling means is adapted to pull said tow of fibers, in sequence, through said compartment and said enclosure;

said circulating means is adapted to circulate air through said preblower venturi into said compartment;

said means for circulating and said preblower venturi are adapted to cooperate to cause said air circulated through said preblower venturi into said compartment to spread said fibers passing through said compartment.

8. The machine of claim 7, wherein said venturi means comprises a venturi orifice, said orifice comprises a movable restriction means for covering a preselected portion of said orifice, said covering of said preselected portion of said orifice being effective to cause said laminar flow of air.

9. The machine of claim 8, wherein said movable restriction is horizontally movable, said covering of said preselected portion by horizontal movement of said movable restriction being effective to cause said laminar flow of air to be in a substantially horizontal plane, whereby to cause said fibers to spread in said substantially horizontal plane.

10. The machine of claim 9, wherein said movable restriction is one or more plates adapted to slide horizontally across said venturi orifice transverse to said circulating air.

11. The machine of claim 10, wherein said venturi orifice is an opening on the surface of said enclosure.

* * * * *